US008297877B2

(12) United States Patent
Erdmann et al.

(10) Patent No.: US 8,297,877 B2
(45) Date of Patent: Oct. 30, 2012

(54) ROTOR BOX FOR A GROUND MILLING MACHINE AND GROUND MILLING MACHINE HAVING SUCH A ROTOR BOX

(75) Inventors: Peter Erdmann, Emmelshausen (DE); Karl-Hermann Moetz, Munich (DE); Robert Laux, Neuwied (DE); Steffen Wachsmann, Koblenz (DE)

(73) Assignee: BOMAG GmbH, Boppard (DE)

( * ) Notice: Subject to any disclaimer, the term of this patent is extended or adjusted under 35 U.S.C. 154(b) by 27 days.

(21) Appl. No.: 13/087,491

(22) Filed: Apr. 15, 2011

(65) Prior Publication Data

US 2011/0293368 A1 Dec. 1, 2011

(30) Foreign Application Priority Data

Apr. 17, 2010 (DE) ..... 10 2010 015 337
Jan. 21, 2011 (DE) ..... 10 2011 009 093

(51) Int. Cl.
*E01C 23/12* (2006.01)

(52) U.S. Cl. ..... 404/94; 404/90; 172/112

(58) Field of Classification Search ..... 404/90, 404/92, 93, 94; 172/108, 112, 554, 777; 37/142.5, 189, 462, 464
See application file for complete search history.

(56) References Cited

U.S. PATENT DOCUMENTS 4,878,713 A 11/1989 Zanetis
5,378,081 A * 1/1995 Swisher, Jr. ..... 299/39.5
7,370,916 B2 * 5/2008 Ley et al. ..... 299/39.2
7,665,806 B2 * 2/2010 Rotz et al. ..... 299/39.4
7,984,953 B2 * 7/2011 Gaertner et al. ..... 299/1.5
2009/0052987 A1 2/2009 Hall et al.
2010/0109421 A1 5/2010 Kraemer

FOREIGN PATENT DOCUMENTS

DE 102 02 536 A1 8/2003
EP 1 070 788 A2 1/2001
GB 2033944 A 5/1980
WO 03062531 A1 7/2003

OTHER PUBLICATIONS

Espacenet, Machine-Generated English Translation of WO 03/062531 A1, retrieved at http://translationportal.epo.org/emtp/translate/?ACTION=description-retrieval&COUNTRY=WO&FORMAT=docdb&KIND=A1&LOCALE=en_EP&NUMBER=03062531&OPS=ops.epo.org&ENGINE=google&SRCLANG=de&TRGLANG=en on May 25, 2012 (17 pages).
European Patent Office, European Search Report, Application No. EP 11 003 171.3, mailed on May 22, 2012 (6 pages).
German Patent and Trademark Office, Search Report, Application No. 10 2011 009 093.2, mailed Sep. 15, 2011 (6 pages).

* cited by examiner

*Primary Examiner* — Raymond W Addie
(74) *Attorney, Agent, or Firm* — Wood, Herron & Evans, LLP

(57) ABSTRACT

The present invention relates to a rotor box for a ground and/or road milling machine such as, in particular, for a road miller or a trench cutter which surrounds at least one milling rotor for removing ground material (B). It is provided that the wall of this rotor box is configured at least in one section with an enlarged distance from the milling rotor in order to allow a specific guiding of the milled material away from the milling rotor in this region of the rotor box and that at least one separating device is disposed between this section of the wall and the milling rotor, which prevents contact of the guided-away milled material with the milling rotor in this region. The present invention further relates to a ground and/or road milling machine such as in particular a road miller or trench cutter having at least one such rotor box.

13 Claims, 3 Drawing Sheets

ROTOR BOX FOR A GROUND MILLING MACHINE AND GROUND MILLING MACHINE HAVING SUCH A ROTOR BOX

The present application claims priority under 35 U.S.C. §119 of German Patent Application No. 10 2010 015 337.0, filed Apr. 17, 2010, and German Patent Application No. 10 2011 009 093.2, filed Jan. 21, 2011, the disclosures of which are hereby incorporated herein by reference in their entireties.

FIELD OF THE INVENTION

The present invention relates to a rotor box for a milling machine, in particular a ground and/or road milling machine. The present invention further relates to a milling machine, in particular a ground and/or road milling machine such as a road miller or a trench cutter, having at least one such rotor box.

BACKGROUND OF THE INVENTION

It is known from the prior art to surround a milling rotor or a milling roller on a generic milling machine by a so-called rotor box. In this regard, reference is made, for example, to EP 1 070 788 A2.

Such a rotor box has an ejector opening from which the ground material (hereinafter called milled material) milled off by the milling rotor can be ejected, for example, onto a conveyor belt which carries it away. Typically this ejector opening does not extend over the entire axial length of the milling rotor so that the milled material in the rotor box must be moved, for example, from side regions towards the ejector opening. This is accomplished, for example, by rows of milling cutters disposed in a helical shape on the milling rotor, where the milling cutters or milling cutter holders promote transport of the milled material in the rotor box as a result of an angle of incidence. A disadvantage here is the severe wear on the milling rotor and in particular on the milling cutters and the milling cutter holders as well as on the rotor box itself.

It is therefore the object of the invention to improve the transport of milled material inside the rotor box.

SUMMARY OF THE INVENTION

The rotor box according to one embodiment of the present invention is used to surround at least one milling rotor provided for the removal of ground material on a milling machine, in particular for a ground and/or road milling machine (both designations are used synonymously hereinafter). It is provided that the wall of this rotor box, i.e., at least the inner wall of this rotor box, is configured at least in one section with an enlarged distance from the milling rotor in order to allow a specific guiding of the removed ground material or milled material away from the milling rotor in the relevant region of the rotor box.

An enlarged distance of the wall from the milling rotor is understood in particular in that in relation to the direction of rotation of the milling rotor, the wall before and after the relevant section, which means in particular a circumferential section in relation to the milling rotor, is configured with a smaller distance from the milling rotor. Consequently, the wall of the rotor box according to one embodiment of the present invention has a varying distance from the milling rotor in relation to the circumferential direction of the housed milling rotor. This measure has the result, for example, that the milled material can be released more easily from the rotating milling rotor and that the milled material released from the milling rotor can describe a flight path inside the rotor box almost unimpaired. The relevant section of the wall which is formed with an enlarged distance from the milling rotor is therefore ideally configured in regard to a release point of the milled material from the milling rotor and in regard to the flight path of the released milled material. However, this measure also has the result, for example, that the milled material moved in the rotor box is significantly less impaired in its movement by the rotor box (than in the rotor boxes known from the prior art) through contact with the milling rotor or the wall of the rotor box.

The section of the wall having an enlarged distance from the milling rotor preferably extends over the entire axial length of the milling rotor. In addition, it is preferably provided that the section of the wall having an enlarged distance from the milling rotor is formed approximately opposite the ejector opening of the rotor box in relation to the milling rotor. This approximately applies to the transition region from the rotor box cover to the rotor box rear wall.

It is further provided that at least one separating device is disposed between the section of the wall which is formed with an enlarged distance from the milling rotor and the milling rotor, which prevents renewed contact of the guided-away milled material (for example, by repulsion or rebound from the wall) with the milling rotor in the relevant inner region of the rotor box. This separating device is preferably arranged in one embodiment so that almost no material can pass between it and the milling rotor. The passage-like region between the separating device and the milling rotor thus remains substantially free from milled material which is advantageous in many respects.

The rotor box according to one embodiment of the present invention has many advantages. One advantage can be seen, for example, in the fact that little wear occurs both on the milling rotor, the milling cutters and the milling cutter holders and on the rotor box or the wall thereof and in particular the inner wall. A further advantage can be seen in that in principle more milled material can be moved in the rotor box according to the present invention with the result that the milling performance of the ground milling machine can be increased.

It is preferably provided in one embodiment that the separating device is configured as a rigid, in particular wing-like and axially extending, longitudinal profile which preferably has a drop-shaped cross-section. The separating device preferably extends over the entire axial length of the milling rotor and extends from one side wall to the opposite side wall of the rotor box. Optionally a support and/or stiffening can be provided over the axial length of the separating device. It is likewise preferably provided that the separating device is disposed inside the rotor box so that it can be exchanged and in particular adjusted in its alignment. It can further be provided to fit the separating device with an impact guard and in particular with an exchangeable impact guard on its front side in relation to the direction of rotation of the milling rotor, which functions as wear protection and/or as a wearing part.

A preferred further development of the present invention according to one embodiment provides that a water sprinkling and/or water jet apparatus is provided on the separating device, which apparatus acts upon the rotating milling rotor with water. This apparatus is preferably disposed on a side of the separating device facing the milling rotor. This measure has the result that as a result of the guided-away milled material and for the purpose of cooling and/or cleaning, an effective sprinkling or drenching of the milling cutter and the milling cutter holder can take place so that its wear is reduced. In order to allow good cleaning, the water must optionally be dispensed with a high pressure.

The water sprinkling and/or water jet apparatus, for example, has a plurality of water jet nozzles which are disposed in an axial direction along the separating device, wherein in principle other devices for spraying water, for example, perforations, etc., can also be used. The water jet nozzles used can be varied comprehensively within the framework of the present invention.

Thus, for example, it is possible to use water jet nozzles which produce a linear focussed water jet during operation. Alternatively to this, however, water jet nozzles from which the water jet emerges at least partially in a conical or fan shape have also proved successful. Combinations are also possible.

A further possibility for variation consists in the specific arrangement of the water jet nozzles or the alignment of the nozzle jet relative to the milling rotor. For example, it is possible to arrange the nozzles in such a manner that their water jet is directed onto the milling rotor in the plane of rotation of the milling rotor. The water jet can impinge upon the milling rotor perpendicular thereto or tilted in or contrary to the direction of rotation.

For water jet nozzles having a fan-shaped and conical water jet, the alignment of the water jet relates to the cone axis or the angle bisector between the two outer legs of the fan, and for water jets having a substantially linear water jet it relates to the longitudinal axis of the water jet. The water jet nozzles can alternatively be arranged with regard to the alignment of the water jet so that they are tilted from the plane of rotation at the separating device as far as arrangements in which the water jet runs parallel to the axis of rotation and/or horizontally. In the case of a conical or fan-shaped water jet, it is quite particularly preferred if the water jet with its generatrix or with its outer fan leg is aligned substantially directed onto at least one cutter tip of a cutter rotating with the milling rotor so that this at least one rotating cutter tip is reliably hit obliquely by the water jet during each rotation of the rotor and for example, is cleaned and/or cooled.

In order to further increase the rotational capacity of the milling cutters in the respective cutter holder, it can additionally be provided that this water sprinkling and/or water jet apparatus is configured to act with water upon the engagement region of the rotating milling rotor in the ground material.

In order to accomplish cooling and/or cleaning of the front sides of the milling rotor, and of the milling cutters and milling cutter holders disposed there, it can further be provided that the rotor box has separate water sprinkling and/or water jet apparatuses which act upon these front sides of the milling rotor with water. These apparatus can be disposed, for example, on the lateral inner wall of the rotor box. Alternatively it would also be possible to form the water sprinkling and/or water jet apparatus on the separating device in such a manner that this also acts upon the front sides of the milling rotor with water. The use of the tilted water jet nozzles already mentioned previously is particularly suitable for this purpose.

BRIEF DESCRIPTION OF THE DRAWINGS

The present invention is explained in detail hereinafter with reference to the figures as an example. In the figures, shown schematically.

DETAILED DESCRIPTION OF THE INVENTION

Figure 1:
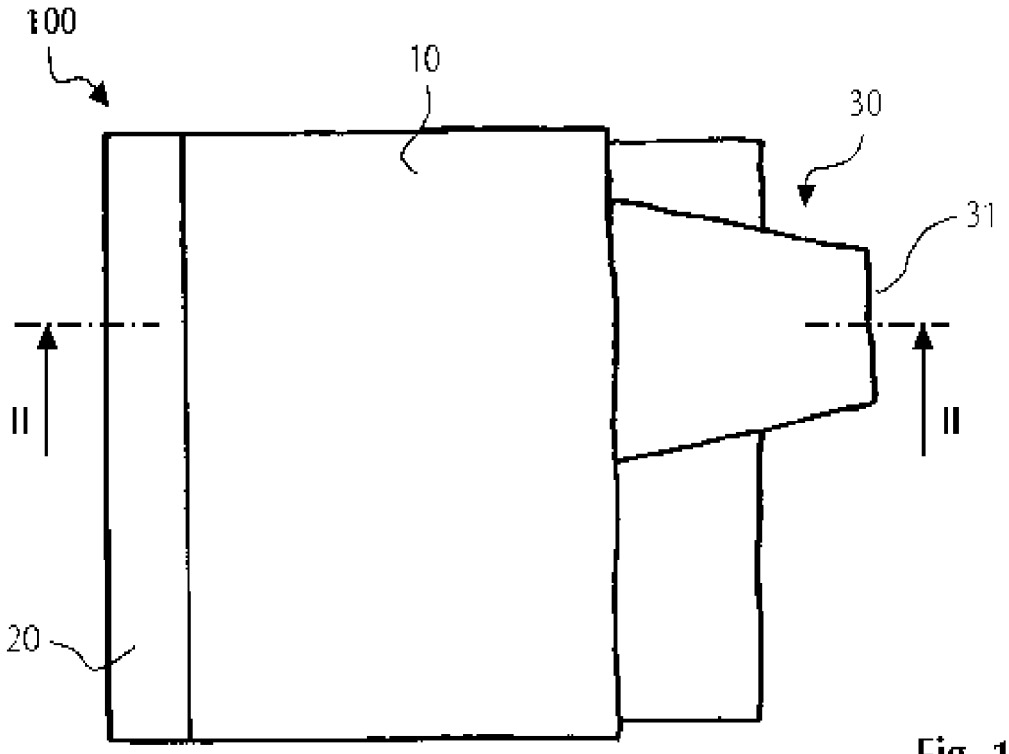
FIG. 1 shows a plan view of a rotor box.

Referring now to the figures, FIG. 1 shows in a plan view a rotor box 100 in which a milling rotor 40 (see FIG. 2 and FIG. 3) is located. The rotor box 100 comprises a wall formed from sheet material which comprises a rotor box cover 10, a rotor box rear wall (rear wall) 20 and an ejector 30 with an ejector opening 31. The ground material (milled material) removed by the milling rotor 40 is conveyed inside the rotor box 100 to the ejector 30. This is accomplished, for example, by rows of milling cutters arranged in a helical shape on the milling rotor 40. A disadvantage here, however, is the severe wear caused by the milled material. It is therefore provided that the wall of the rotor box 100 is formed at least in one section with an enlarged and in particular large distance from the milling rotor 40, which enables a specific guidance of the removed milled material away from the milling rotor 40. This will be explained hereafter in connection with FIG. 2.

Figure 2:
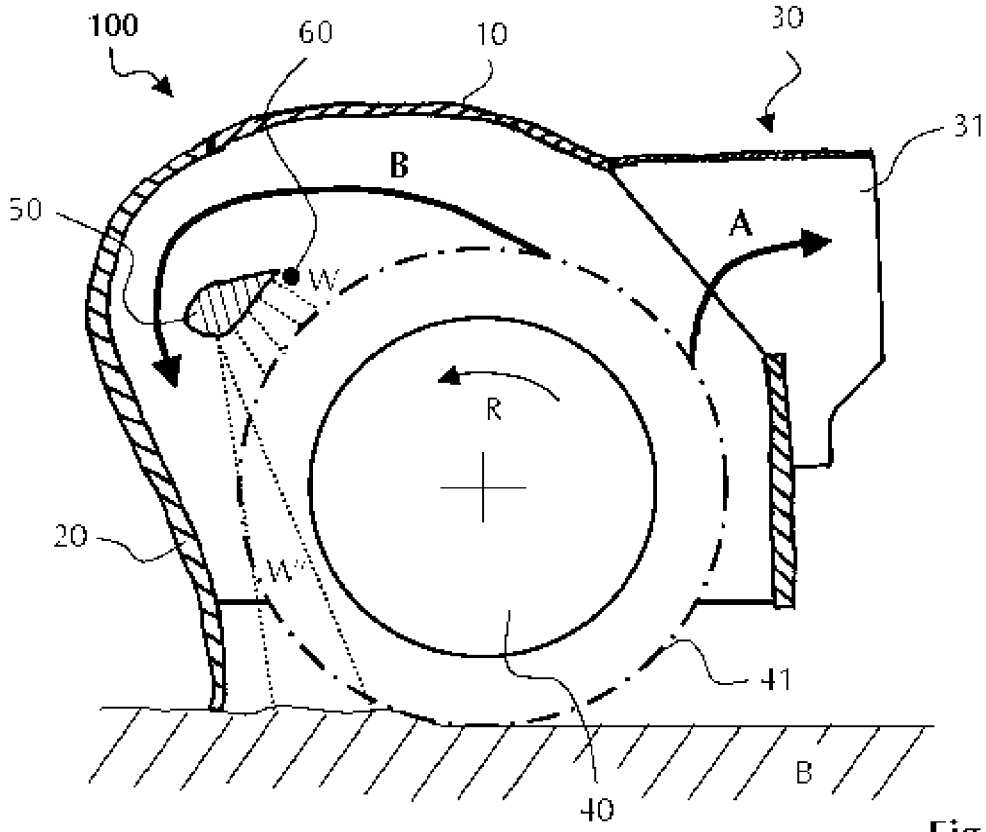
FIG. 2 shows a sectional view through the rotor box according to FIG. 1 according to the sectional profile given in FIG. 1.
Figure 3:
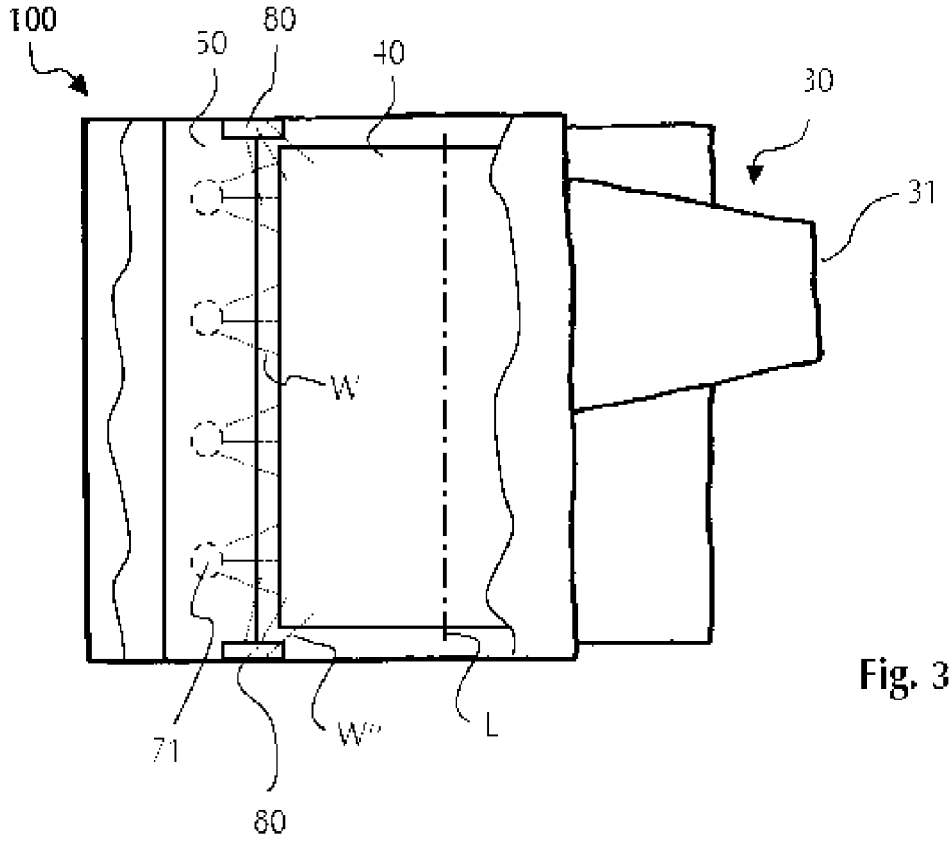
FIG. 3 shows a diagram of the interior of the rotor box from FIG. 1 in a plan view.

FIG. 2 shows a section through the rotor box 100 according to the sectional profile II-II given in FIG. 1. The milling rotor is designated by 40 and the cutter engagement curve of the milling cutter fastened to the outer jacket is designated with 41. In milling operation, the milling rotor 40 rotates in the specified direction R, whereby the milling cutters release the ground material B to be removed and entrain it as milled material. A fraction of the entrained milled material is ejected through the ejector opening 31 of the ejector 30, which is indicated by the arrow A. A so-called launcher (not shown) can be provided for this purpose on the milling rotor 40 for assistance. Another fraction of the entrained milled material, however, is only released by the milling rotor 40 subsequently due to centrifugal force and thus remains inside the rotor box 100.

The wall section of the rotor box 100 opposite the ejector opening 31 is formed with a relatively large distance from the milling rotor 40. This section extends in the transition region from the rotor box cover 10 to the rotor box rear wall 20. This enables a specific guidance of the milled material away from the milling rotor 40 in the relevant region in the interior of the rotor box 100. Furthermore, the milled material released from the milling rotor 40 is scarcely impaired in its flight path by any contact with the wall of the rotor box 100 and/or with the milling rotor 40, which is indicated by the arrow B.

Since the wall (or at least the inner wall) of the rotor box 100 is formed with an enlarged distance from the milling rotor 40 in the relevant section, so to speak a free flight path of the milled material is rendered possible (see arrow B). An abrasive wear by impacting milled material on the wall of the rotor box 100 and/or the milling rotor 40 is largely prevented. As a precaution, however the rotor box rear wall 20 is reinforced (for example, made of a thicker material) in order to be able to withstand impacts and resulting interactions. The milled material guided away from the milling rotor 40 finally again enters into the engagement region of the milling cutters. Although the wall of the rotor box 100 in the relevant region has an enlarged distance from the milling rotor 40, the rotor box 100 according to the present invention nevertheless has a compact and light construction.

Unlike the exemplary embodiment shown in FIG. 2, the relevant section of the wall of the rotor box 100 having an enlarged distance from the milling rotor 40 can also be configured differently and, for example, composed of flat partial surfaces. The arcuate contour shown is merely an example. What is important is that a release and substantially free flying of the milled material is made possible.

A wing-like separating device having a drop-shaped cross-section in the interior of the rotor box 100 is designated by 50, and separates the region of the wall having the large distance from the milling rotor 40. The separating device 50 is configured as a rigid longitudinal profile and extends parallel to the longitudinal axis or axis of rotation L of the milling rotor 40 (see FIG. 3). The separating device 50 prevents the milled material guided away from the milling rotor 40 from coming in contact with the milling rotor 40 again and forms a passage 60 (between the separating device 50 and the milling rotor 40) which is substantially free from milled material. The tip of the separating device 50 having a drop-shaped cross-section points in the direction opposite to the direction of rotation R of the milling rotor 40, with the result that the risk of impact of milled material is reduced. The separating device 50 is preferably arranged in one embodiment so that it can be exchanged and in particular so that it can be adjusted so that, for example, its distance from the milling rotor 40 and/or its inclination can be changed.

A water sprinkling and/or water jet apparatus is provided on the separating device 50, which acts upon the rotating milling rotor 40 with water W. Since the passage 60 remains substantially free from milled material, the water W can impinge almost unhindered on the milling rotor 40 or on the milling cutters and milling cutter holder thereof, which is depicted schematically by the lines W. The water W is used for cleaning and optionally also for pressure cleaning of the milling cutters and milling cutter holder, whereby the milling performance is increased. The water W is further used for cooling the milling cutters in milling operation so that the milling cutters can engage again in the ground material to be processed after being cooled. By this means, the wear of the milling cutters can be reduced significantly. The cleaning and/or cooling of the milling cutters with the water W assumes that a quasi milling-material-free space (passage 60) is created near the milling rotor 40, which is accomplished on the one hand by the configuration of the rotor box 100 and on the other hand by the separating device 50. The water supply for the water sprinkling and/or water jet apparatus is not shown in detail.

The water sprinkling and/or water jet apparatus is further configured for acting upon the engagement region of the milling rotor 40 in the ground material B with water, which is depicted schematically by the lines W' which extend through the milling cutters and the milling cutter holder. The rotational capacity of the milling cutters can be increased by this means.

Figure 5:
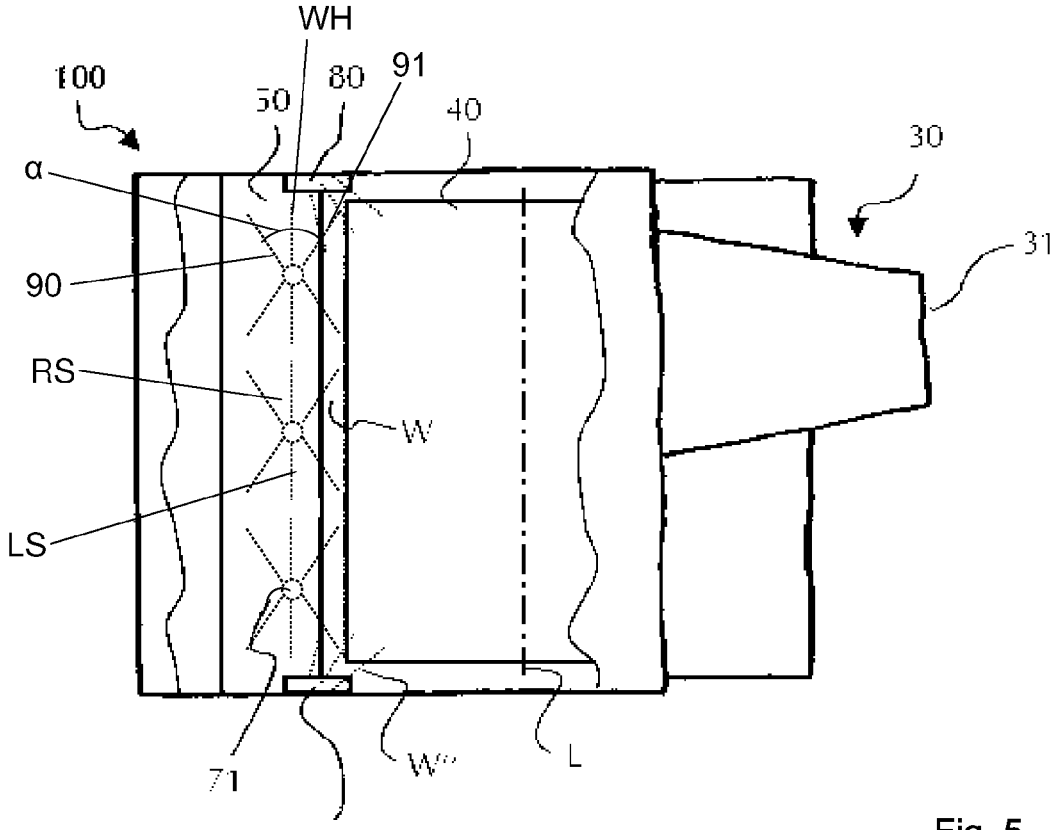
FIG. 5 shows the embodiment from FIG. 3 with an alternative arrangement of the water jet nozzles.
Figure 6:
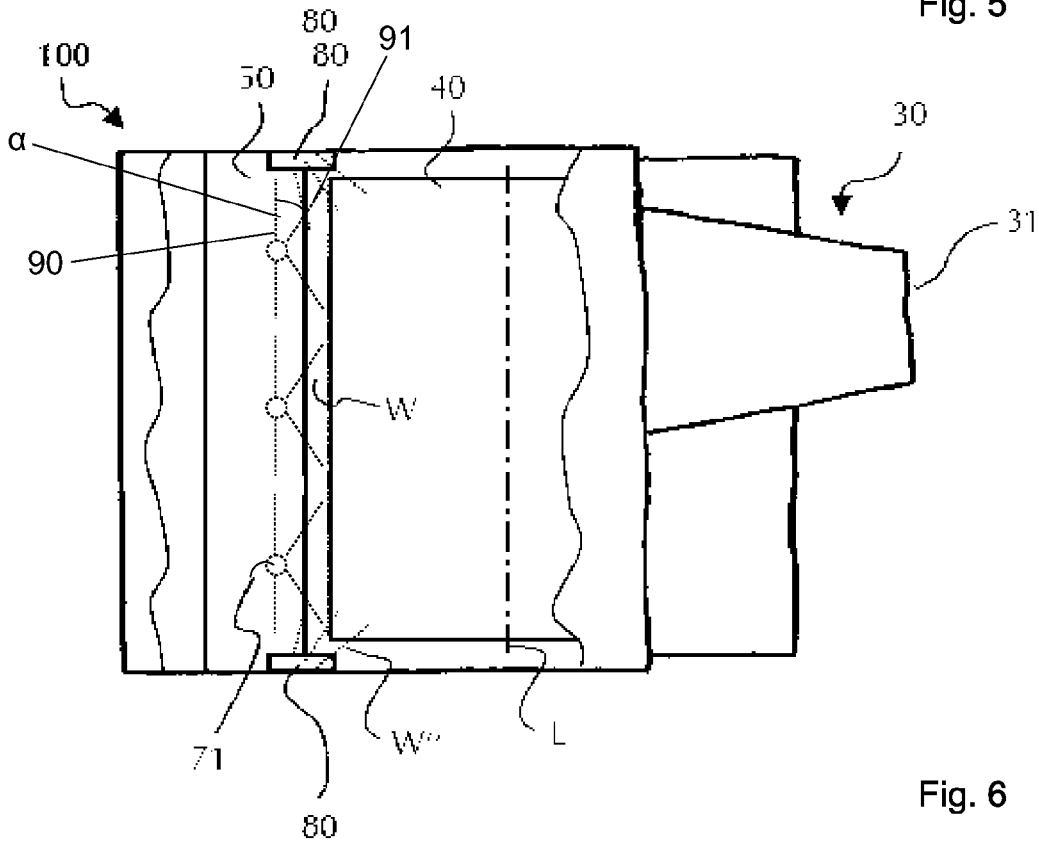
FIG. 6 shows another alternative arrangement of the water jet nozzles starting from the embodiment from FIGS. 3 and 5.

The water sprinkling and/or water jet apparatus is formed from a plurality of water jet nozzles 71 which are arranged in the axial direction along the separating device 50. This can be identified very clearly in FIG. 3 in which the view into the interior of the rotor box 100 is exposed. It can also be very clearly deduced from the diagram in FIG. 3 that the separating device 50 is aligned parallel to the axis L of the milling rotor 40. It can further be deduced from the cross-sectional view from FIG. 2 that the individual water jet nozzles 71 are arranged on the separating device 50 in such a manner that their substantially conical water jet W in the present exemplary embodiment (it also being possible to use water jet nozzles having a linear or fan-shaped water jet) is directed almost completely directly onto the milling rotor 40. Alternative arrangements of the water jet nozzles 71 are obtained from FIGS. 5 and 6 in which the water jet nozzles 71 are arranged in such a manner than the water jet W is tilted in the horizontal direction. Furthermore, the water jet nozzles in FIGS. 5 and 6 are configured in such a manner that they deliver two mutually opposite individual jets, a right-hand jet RS and a left-hand jet LS, per water jet nozzle. The water jet W in FIGS. 5 and 6 is furthermore fan-shaped in each case and at its fan edges respectively embraces an outer leg 90 or 91. The reference point for the alignment of the fan is the angle bisector WH between the outer legs 90 and 91 which in the exemplary embodiment according to FIG. 5 runs parallel to the longitudinal axis or axis of rotation L of the milling rotor 40. The angle delimited by the two outer legs 90 and 91 is given by "α". The outer legs 91 directed towards the milling rotor 40 therefore impinge obliquely on the milling rotor 40 and are positioned in their position such that they specifically impinge on at least one tip of a cutter disposed on the milling rotor 40 (not shown in the figures). Unlike the embodiment in FIG. 5, the spray fan of the water jet nozzles 71 in FIG. 6 is modified in such a manner that the outer leg 90 facing away from the milling rotor 40 runs parallel to the longitudinal axis or axis of rotation L.

The reference number 80 denotes water sprinkling and/or water jet apparatuses disposed on the lateral inner wall of the rotor box 100 which act upon the front sides of the milling rotor 40 with water W" in order to cool and/or clean the milling cutters and milling cutter holder located in this region. The water supply for these water sprinkling and/or water jet apparatuses is not shown in detail.

Figure 4:
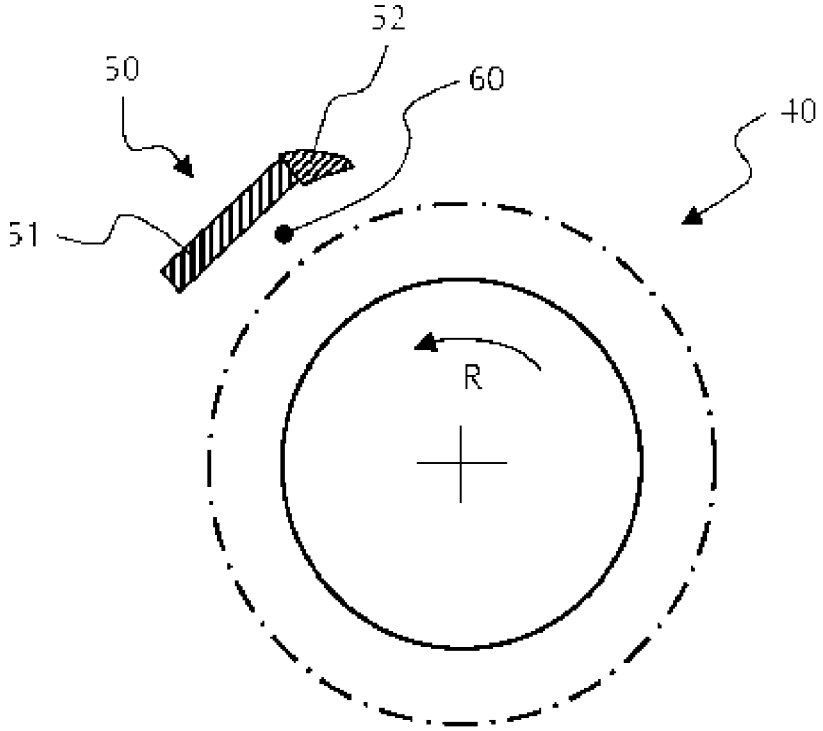
FIG. 4 shows an alternative embodiment of a separating device in a sectional view.

FIG. 4 shows an embodiment of a separating device 50 with a flat rectangular longitudinal profile 51 which is provided with an exchangeable impact guard 52 on its front side in relation to the direction of rotation R of the milling rotor 40. Such an impact guard 52 can be configured, for example, as a wearing part.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of Applicants' invention.

What is claimed is:

1. A rotor box for a ground and/or road milling machine, comprising:

at least one milling rotor for removing ground material, wherein a wall of the rotor box is configured at least in one section with an enlarged distance from the milling rotor to allow a guiding of the milled material away from the milling rotor in this region of the rotor box and that at least one separating device is disposed between this section of the wall and the milling rotor which prevents contact of the guided-away milled material with the milling rotor in this region.

2. The rotor box according to claim 1, wherein the separating device is configured as a rigid longitudinal profile.

3. The rotor box according to claim 1, wherein the separating device is disposed inside the rotor box so that it can be exchanged and/or adjusted in its alignment.

4. The rotor box according to claim 1, wherein the separating device is fitted with an impact guard.

5. The rotor box according to claim 1, wherein a water sprinkling and/or water jet apparatus is provided on the separating device, which water jet apparatus acts upon the rotating milling rotor with water.

6. The rotor box according to claim 5, wherein the water sprinkling and/or water jet apparatus is configured to act upon the engagement region of the rotating milling rotor in the ground material with water.

7. The rotor box according to claim 5, wherein the water sprinkling and/or water jet apparatus comprises a plurality of water jet nozzles which are disposed in the axial direction along the separating device.

8. The rotor box according to claim 1, wherein the rotor box has separate water sprinkling and/or water jet apparatuses which act upon front sides of the rotating milling rotor with water.

9. The rotor box according to claim 1, wherein the rotor box has an ejector opening and that the section of the wall having the enlarged distance from the milling rotor is configured to be approximately opposite the ejector opening in relation to the milling rotor.

10. A ground and/or road milling machine, comprising at least one rotor box according to claim 1.

11. The rotor box according to claim 4, wherein the impact guard comprises an exchangeable impact guard.

12. The rotor box according to claim 6, wherein the water sprinkling and/or water jet apparatus comprises a plurality of water jet nozzles which are disposed in the axial direction along the separating device.

13. The ground and/or road milling machine of claim 10, wherein the ground and/or road milling machine comprises a road miller or trench cutter.

* * * * *